United States Patent [19]

Riedisser et al.

[11] Patent Number: 5,065,636

[45] Date of Patent: Nov. 19, 1991

[54] DRIVE ARRANGEMENT FOR A MALE-DIE-SIDE EJECTOR SLIDABLY DISPOSED IN A SLIDE OF A MECHANICAL METAL-FORMING PRESS

[75] Inventors: Günter Riedisser, Eisslingen; Rainer Braun, Göppingen, both of Fed. Rep. of Germany

[73] Assignee: L. Schuler Pressen GmbH, Fed. Rep. of Germany

[21] Appl. No.: 478,457

[22] Filed: Feb. 8, 1990

[30] Foreign Application Priority Data

Feb. 14, 1989 [DE] Fed. Rep. of Germany ..... 3904278

[51] Int. Cl.[5] ..... B21J 13/14; B30B 15/00

[52] U.S. Cl. ..... 74/40; 72/345; 72/427; 164/347; 249/68; 425/422; 425/444

[58] Field of Search ..... 72/344, 345, 427; 74/40, 53, 99 A; 249/67, 68; 425/422, 444, 556; 164/347

[56] References Cited

U.S. PATENT DOCUMENTS

| | | | |
|---|---|---|---|
| 56,897 | 8/1866 | Butler | 72/345 |
| 3,122,033 | 2/1964 | Riemenschneider et al. | 72/427 |
| 3,171,144 | 3/1965 | Maistros | 72/427 X |
| 3,299,453 | 1/1967 | van de Meerendonk | 72/427 X |
| 3,699,882 | 10/1972 | Keithley et al. | 72/345 X |
| 4,552,525 | 11/1985 | Stehr | 425/422 |

FOREIGN PATENT DOCUMENTS

| | | | |
|---|---|---|---|
| 241571 | 10/1987 | European Pat. Off. | 72/345 |
| 739316 | 11/1943 | Fed. Rep. of Germany | 72/427 |
| 0925566 | 3/1955 | Fed. Rep. of Germany . | |
| 1059268 | 12/1959 | Fed. Rep. of Germany . | |
| 1927830 | 12/1970 | Fed. Rep. of Germany | 72/345 |
| 1750033 | 5/1971 | Fed. Rep. of Germany . | |
| 2102571 | 8/1971 | Fed. Rep. of Germany . | |
| 2135405 | 8/1974 | Fed. Rep. of Germany . | |
| 1627977 | 1/1978 | Fed. Rep. of Germany . | |
| 2827561 | 1/1980 | Fed. Rep. of Germany . | |
| 2450631 | 5/1980 | Fed. Rep. of Germany . | |
| 2812695 | 2/1981 | Fed. Rep. of Germany . | |
| 3437282 | 4/1986 | Fed. Rep. of Germany . | |
| 58-199636 | 11/1983 | Japan | 72/345 |
| 0780830 | 8/1957 | United Kingdom . | |

*Primary Examiner*—Leslie A. Braun
*Assistant Examiner*—Scott Anchell
*Attorney, Agent, or Firm*—Evenson, Wands, Edwards, Lenahan & McKeown

[57] ABSTRACT

In the case of a drive for a male-die-side ejector slidably disposed in a slide of a mechanical metal-forming press having an angle lever which is pivotably disposed at the slide, one leg of the lever acting upon the end of the ejector facing way from the male die and the other leg thereof being acted upon by a control cam which is driven in a timed manner and being held in contact with this control cam, a free adjustability of the moving characteristics of the ejector is achieved in that the control cam is provided at a control carriage which is slidable in a guide fixed at the frame in parallel to the moving direction of the slide, and at which a control connecting rod is applied in a bearing, this control connecting rod, at one end, being disposed eccentrically on a shaft serving also as the drive of the slide.

6 Claims, 3 Drawing Sheets

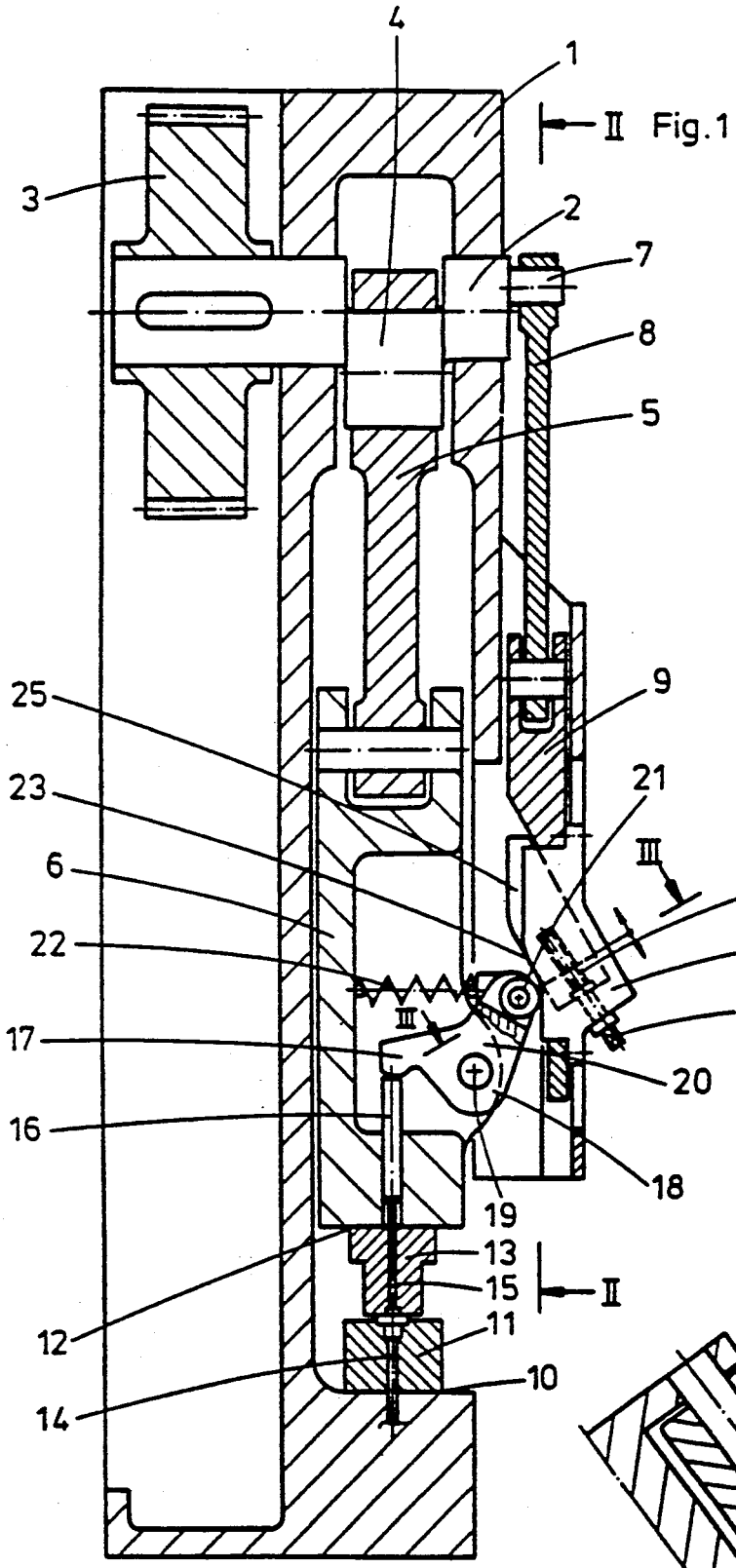
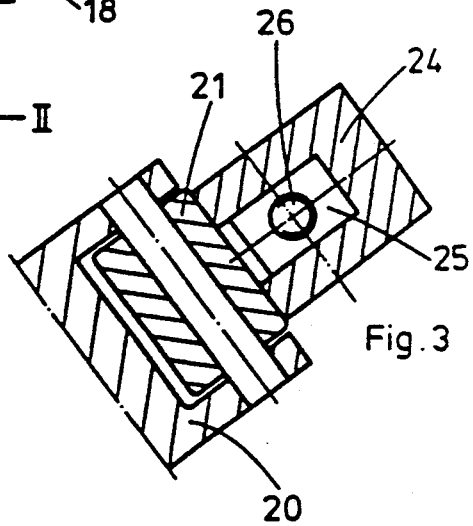
Fig.3

DRIVE ARRANGEMENT FOR A MALE-DIE-SIDE EJECTOR SLIDABLY DISPOSED IN A SLIDE OF A MECHANICAL METAL-FORMING PRESS

BACKGROUND AND SUMMARY OF THE INVENTION

The present invention generally relates to a drive arrangement for an ejector for a male-die of a mechanical metal-forming press, and more particularly, to such a drive arrangement wherein the male-die-side ejector is slidably disposed in a slide of a mechanical metal-forming press having an angle lever which is pivotably disposed at the slide, one leg of the angle lever acting upon an end of the ejector facing away from the male die and the other leg of the angle lever being acted upon by a control cam which is driven in a timed manner and is held in contact with this other leg of the angle lever.

In the case of press arrangements having an angle lever pivotably disposed at the slide accommodating a male-die-side ejector, the ejector may selectively be a pin-shaped ejector which penetrates the male die, as disclosed, for example, in German Published, Unexamined Patent Application (DE-OS) 28 27 61 A1, or an ejector comprising at least one pin extending in parallel to and outside the male die and possibly an ejector sleeve surrounding the male die for workpieces that are approximately sleeve-shaped or are provided with a central recess. See, for example, German Patent Specification (DE-PS) 925 566 C3.

Furthermore, in the case of drives of this type, the other leg of the angle lever may also be held in a force-locking or form-fitting contact with the control cam which drives it in a timed manner. This may, for example, take place by means of the effect of a spring or by constructing the control cam at an orbiform-curve cam plate (see, for example, German Published, Unexamined Patent Application (DE-OS) 21 02 571 A1), or by a groove-shaped construction of the control cam with limitations on both sides.

Drives of the initially mentioned type are disclosed in numerous constructions.

Some of these disclosed drive arrangements have multimember transmission gears in the drive of the control cam and/or of the transmission of motion to the angle lever. See, for example, German Published, Examined Patent Application (DE-AS) 24 50 631 B2, German Patent Specification (DE-PS) 28 27 561 A1, or German Published, Examined Patent Application (DE-AS) 17 50 033 B2. The multipart characteristic of these constructions causes high manufacturing and maintenance costs.

In other disclosed drive arrangements, the drive of the control cam is derived from the connecting rod used for driving the slide. See, for example, German Published, Examined Patent Application (DE-AS) 16 27 977 B2, of German Patent Specification (DE-PS) 28 12 695 C3. However, a free adjustability of the movement of the ejector with respect to the movement of the slide cannot be achieved by means of constructions of this type.

In another disclosed drive arrangement, the driving of the control cam disposed at the slide takes place by means of a profiled splined-shaft connection which, in a timed manner, must absorb changes of length with respect to the extent of the slide stroke. See German Published, Examined Patent Application (DE-AS) 21 35 405 B2. This type of a construction is expensive and not very maintenance-friendly.

Also, in another disclosed drive arrangement, only a driven movement of the control cam in transverse direction to the moving direction of the slide is provided so that no free adjustability can be achieved of the movement of the ejector in relation to the movement of the slide. See German Published, Unexamined Patent Application (DE-OS) 34 37 282 A1.

In view of the mentioned state of the art, one object on which the present invention is based includes permitting a free adjustability of the moving characteristics of the ejector with a construction of the drive that is as simple as possible, has few components and is not very susceptible to trouble while the above-mentioned disadvantages are avoided, specifically by means which result in a display of the selected adjustment.

In a drive of the initially mentioned type, this object and other objects are achieved in that the control cam is provided at a control carriage which, in a guide fixed at the frame, can be slid in parallel to the moving direction of the slide and to which, in a bearing, a control connecting rod is applied which, at the other end, is eccentrically disposed on a shaft which also serves the driving of the slide. The shaft which also serves the driving of the slide, in one embodiment of the present invention, may be the main drive shaft of the press which carries an eccentric for the drive of the slide as well as a shaft which is connected in front of it in the drive train of gears for the latter and rotates at the same rotational speed.

The space-saving construction of the drive arrangement according to preferred embodiments of the present invention is of special significance when it is used in a multiple manner in a multistage metal-forming press.

The invention can be used in metal-forming presses with a vertical operating direction of the slide as well as in those with a horizontal operating direction of the slide.

However, in the case of a multistage metal-forming press, a drive is disclosed for the female-die-side ejectors (see German Patent Specification (DE-PS) 10 59 268 C3) in which a control carriage, in a guide fixed at the frame, is slidably driven in parallel to the moving direction of the slide by means of a control connecting rod by an eccentric disposed on the main drive shaft of the press. Exchangeable control cams are provided there in the common control carriage which is used for driving the ejectors in all female dies, for the driving of each ejector by way of angle levers disposed in a swivelling manner at the frame. However, these are ejectors on the side of the female die for the drive of which a transmission of movements to angle levers disposed in the slide is not required.

Other objects, advantages and novel features of the present inventions will become apparent from the following detailed description of the invention when considered in conjunction with the accompanying drawings.

BRIEF DESCRIPTION OF THE DRAWINGS

FIG. 1 is a vertical central sectional view of the metal-forming press in the plane containing its main drive shaft according to one embodiment of the present invention;

FIG. 3 is a sectional view along Line III—III in FIG. 1, and

DETAILED DESCRIPTION OF THE DRAWINGS

Figure 2:
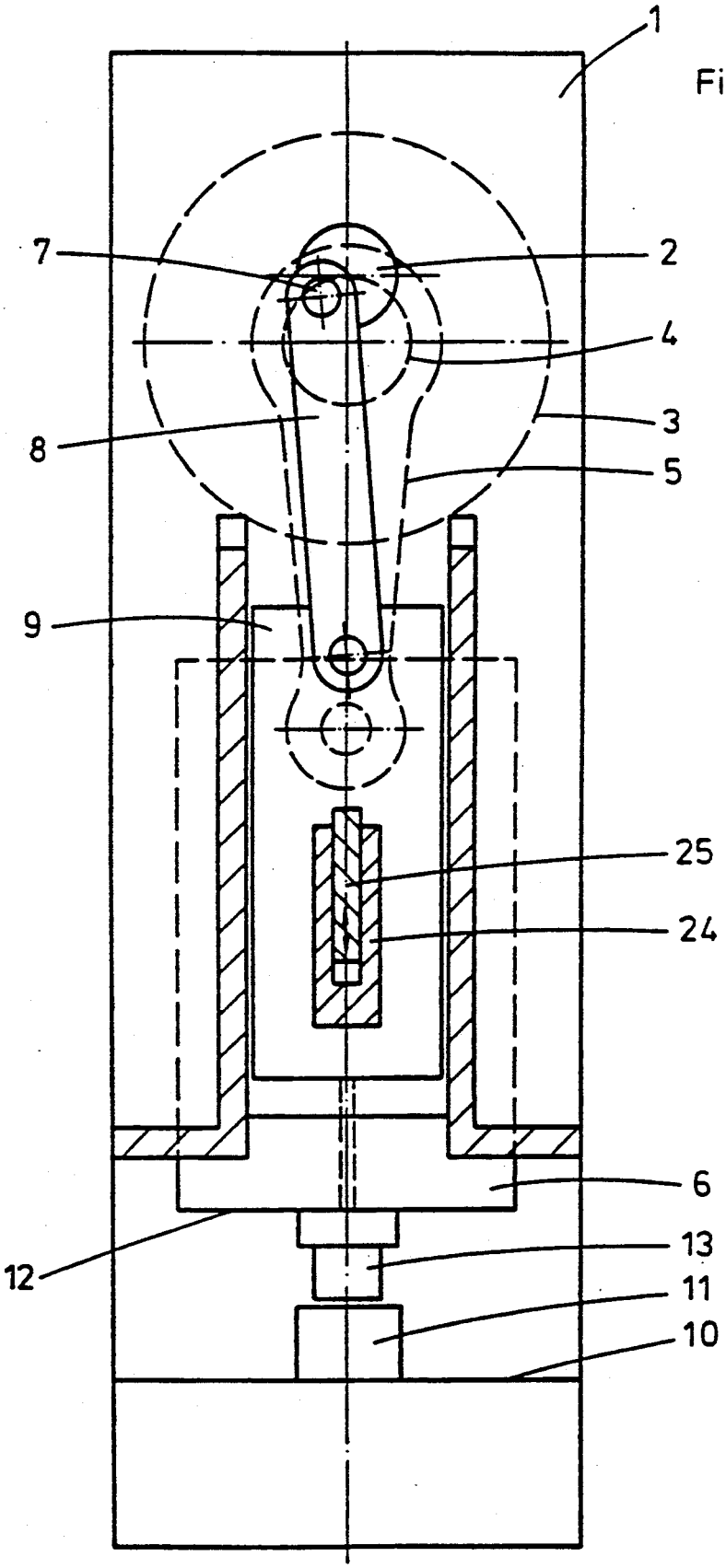
FIG. 2 is a sectional view along Line II—II in FIG. 1.

In the specification, an embodiment is shown in FIGS. 1–3 of a drive arrangement according to the invention on a one-stage metal-forming press.

As shown is FIG. 1, a main drive shaft 2 of a metal-forming press is disposed in a frame 1 and is driven by a motor (not shown) by way of, for example, a toothed wheel 3. The main drive shaft 2 has an eccentric 4 on which a driving connecting rod 5 is disposed which, at the other end, is pivotably connected with a slide 6 which is vertically movably guided in the frame 1. In addition, the main drive shaft 2 is equipped with an eccentric crank 7 on which a control connecting rod 8 is disposed which, at the other end, is pivotably connected to a control carriage 9 which is vertically slidably guided at the frame 1.

At the lower part of the frame 1, a table-type mounting area 10 is constructed for a female die 11 which is mounted thereon. A male die 13, which is fastened to a sole 12 of the slide 6, interacts with the female die 11. In the female die 11, a pin-shaped ejector 14 is disposed which penetrates it and which is acted upon by a drive arrangement (not shown). A pin-shaped ejector 15 is also movably guided in the male die 13 and penetrates it.

A control pin 16, which is slidably guided in the slide 6, rests on the end of the ejector 15 facing away from the impression of the male die 13, a leg 17 of an angle lever 18 acting upon the end of this control pin 16 facing away from the ejector 15. The angle lever 18 is pivotably disposed on a bolt 19 in the slide 6. The other leg 20 of the angle lever 18 carries a rotatable roller 21 and is under the effect of a pressure spring 22 which is supported at the slide 6 at the other end, this pressure spring 22 holding the roller 21 in contact with a control cam 23.

The control cam 23 is partially constructed at an exchangeable component 24 which is detachably fastened to the control carriage 9. In component 24, a slider 25 is arranged which is slidable at an acute angle to the moving direction of the control carriage 9 and can be locked. A surface at the slider 25 forms an additional part of the control cam 23. The sliding and locking of the slider 25 in component 24 takes place by means of a screw 26 which can be screwed into the slider 25 and can be rotated in the component 24 but is non-slidably disposed in longitudinal direction and has a square portion 27 for the purpose of being operated. A known connecting-rod parallelogram linkage of the type shown in U.S. Pat. No. 3,902,606 can be included at the control carriage 9.

The length of the control cam 23 as well as the angular position and the size of the eccentrics 4, (crank) 7 are dimensioned such that the roller 21 always remains in contact with the control cam 23. By the selection of the shape and the adjustment of the control cam 23, the position of the stroke of the ejector 15 can be changed in relation to the stroke of the slide 6 as well as the size of the stroke of the ejector 15. The adjustment of the slider 25 alone causes only a change of the size of the stroke of the ejector 15; in the completely withdrawn position of the slider 25, the stroke of the ejector 15 is a minimum.

Figure 4:
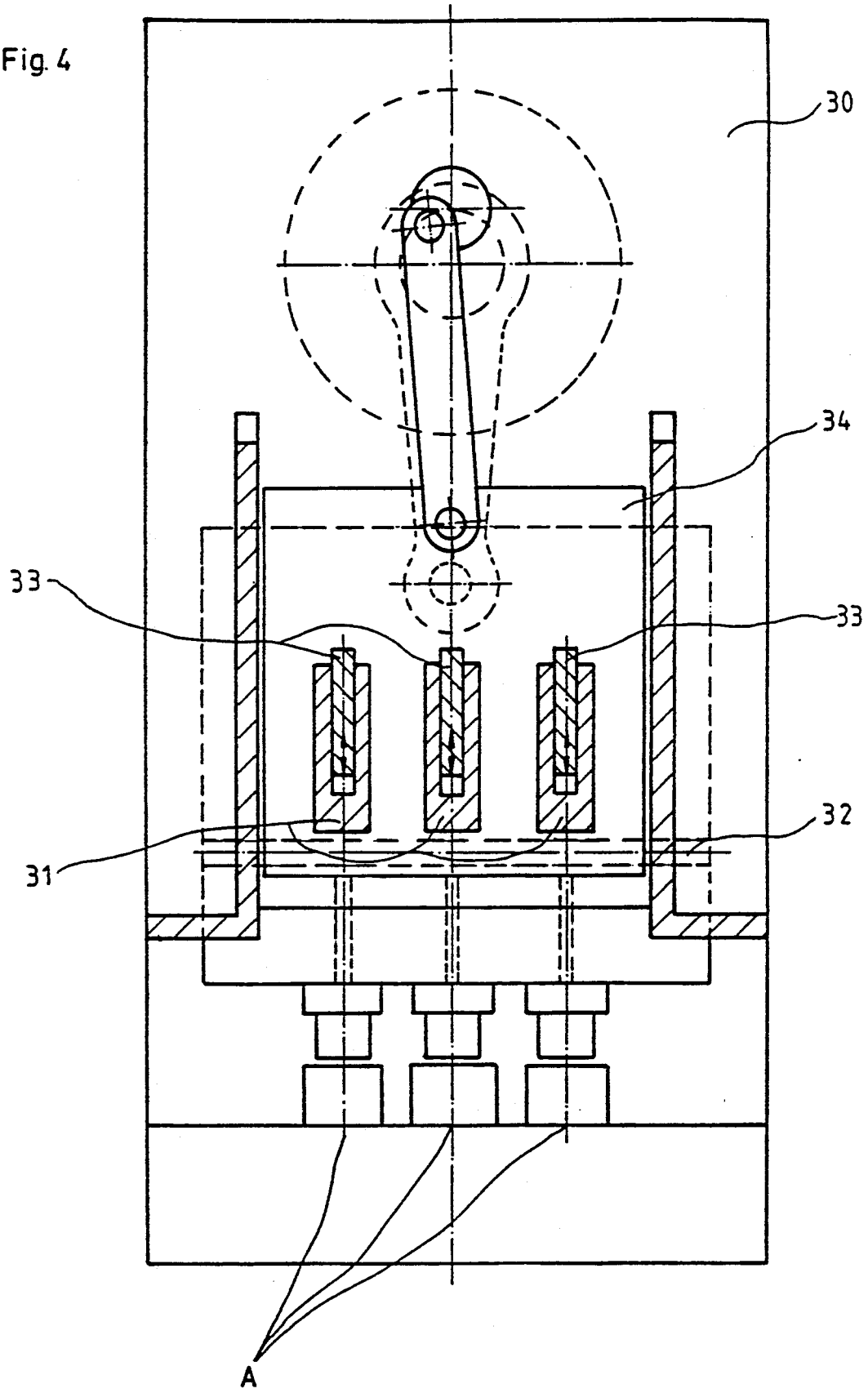
FIG. 4 illustrates a further embodiment of the present invention as applied to a multistage metal-forming press.

Referring to FIG. 4 a further embodiment of the present invention is illustrated for use in a multistage metal-forming press 30 wherein, in a number that is equal to the number of stages A of the press 30, angle levers are disposed on a common shaft 32 and control cams are provided at a common control carriage 34, each cam being formed by a component 31 and a slider 33.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A drive arrangement for a male-die-side ejector slidably disposed in a slide of a mechanical metal-forming press comprising:
   - an angle lever pivotably disposed on the slide, one leg of which acts upon an end of the ejector facing away from the male die and another leg of which is acted upon by a control cam;
   - means for driving the control cam in a timed manner;
   - means for holding the control cam in contact with the other leg of the angle lever;
   - a control carriage attached to the control cam, the control carriage being slid in a guide fixed at a stationary frame positioned substantially parallel to a moving direction of the slide which also moves relative to the frame; and
   - a control connecting rod attached at one end to the control carriage at a bearing, and at another end, being disposed eccentrically on a shaft which drives the slide.

2. A drive arrangement according to claim 1, wherein the control cam is fastened to the control carriage as an exchangeable component.

3. A drive arrangement according to claim 1, wherein the control cam is adjustably disposed at the control carriage by an adjustment mechanism.

4. A drive arrangement according to claim 3, wherein the adjustment mechanism of the control cam includes a straight line mechanism at the control carriage which is arranged at an angle to the guide fixed at the frame, and releasable locking devices.

5. A drive arrangement according to claim 3, wherein the adjustment mechanism of the control cam includes a pairing of two wedge surfaces which rest against one another, one of which is provided at the component having the control cam and another one of which is provided at the control carriage, and releasable locking devices.

6. A drive arrangement for use in a multistate metal-forming press, comprising:
   - an angle lever pivotably disposed at the slide, one leg of which acts upon an end of the ejector facing away from the male die and another leg of which is acted upon by a control cam;
   - means for driving the control cam in a timed manner;
   - means for holding the control cam in contact with the other leg of the angle lever;
   - a control carriage attached to the control cam, the control carriage being slid in a guide fixed at a stationary frame positioned substantially parallel to a moving direction of the slide which also moves relative to the frame; and a control connecting rod attached at one end to the control carriage at a bearing, and at another end, being disposed eccentrically on a shaft which drives the slide;

wherein, in a number that is equal to the number of states of the press, angle levers are disposed on a common shaft and control cams are provided at a common control carriage.

* * * * *